US007751573B2

(12) United States Patent
Aiso et al.

(10) Patent No.: US 7,751,573 B2
(45) Date of Patent: Jul. 6, 2010

(54) CLIP STATE DISPLAY METHOD, CLIP STATE DISPLAY APPARATUS, AND CLIP STATE DISPLAY PROGRAM

(75) Inventors: Masaru Aiso, Hamamatsu (JP); Kotaro Terada, Hamamatsu (JP); Takamitsu Aoki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1107 days.

(21) Appl. No.: 10/916,344

(22) Filed: Aug. 10, 2004

(65) Prior Publication Data

US 2005/0036634 A1 Feb. 17, 2005

(30) Foreign Application Priority Data

Aug. 11, 2003 (JP) ..... 2003-291759

(51) Int. Cl.
*H04R 29/00* (2006.01)
*H03G 3/00* (2006.01)
*G06F 17/00* (2006.01)

(52) U.S. Cl. ..... 381/56; 381/61; 700/94; 715/716; 715/727

(58) Field of Classification Search ..... 700/94; 381/56, 61; 715/716, 718, 727, 728
See application file for complete search history.

(56) References Cited

U.S. PATENT DOCUMENTS

| | | | | |
|---|---|---|---|---|
| 7,319,761 | B2 * | 1/2008 | Bianchi et al. | 381/56 |
| 2002/0037085 | A1 * | 3/2002 | Ono | 381/119 |
| 2002/0080981 | A1 | 6/2002 | Aoki et al. | 381/56 |

FOREIGN PATENT DOCUMENTS

| | | |
|---|---|---|
| JP | 06-250636 | 9/1994 |
| JP | 8-125455 | 5/1996 |

OTHER PUBLICATIONS

Japanese Office Action with English Translation, for JP No. 2003-291759, mailed Oct. 14, 2008.

* cited by examiner

*Primary Examiner*—Vivian Chin
*Assistant Examiner*—Douglas J Suthers
(74) *Attorney, Agent, or Firm*—Morrison & Foerster LLP

(57) ABSTRACT

A clip state display method which is capable of quickly identifying a clipping point and changing settings of signal processing. It is detected whether a clip occurs in any of signals of a plurality of input channels on which at least one of signal processing and mixing processing is performed. A block diagram showing functions of at least one of the signal processing and the mixing processing is displayed. Functions of at least one of the signal processing and the mixing processing in which the clip has occurred are displayed on the block diagram.

3 Claims, 3 Drawing Sheets

CLIP STATE DISPLAY METHOD, CLIP STATE DISPLAY APPARATUS, AND CLIP STATE DISPLAY PROGRAM

BACKGROUND OF THE INVENTION

1. Field of the Invention

The present invention relates to a clip state display method, a clip state display apparatus, and a clip state display program, which can be suitably applied to an audio signal mixing apparatus.

2. Description of the Related Art

Conventionally, there has been known a mixing apparatus which synthesizes audio signals input through a plurality of input channels. In this mixing apparatus, various kinds of signal processing such as level adjustment and equalizer adjustment are performed on audio signals input through respective input channels. In Japanese Laid-Open Patent Publication (Kokai) No. 2002-191091, a mixing apparatus is disclosed which monitors the signal level of an audio signal at each adjustment point (metering point) so as to display an alarm when a clip occurs and the signal level of the audio signal satisfies a predetermined level condition.

By the way, if the signal level of an audio signal is high and a clip occurs, the audio signal is significantly degraded. Thus, it is necessary to identify the clipping point and change the settings of signal processing as quickly as possible so as to avoid subsequent occurrence of a clip.

SUMMARY OF THE INVENTION

It is therefore an object of the present invention to provide a clip state display method and a clip state display apparatus which are capable of quickly identifying a clipping point and changing the settings of signal processing, as well as a clip state display program.

To attain the above object, in a first aspect of the present invention, there is provided a clip state display method comprising a clip detecting step of detecting whether a clip occurs in any of signals of a plurality of input channels on which at least one of signal processing and mixing processing is performed, a block diagram display step of displaying a block diagram showing functions of at least one of the signal processing and the mixing processing, and a clip display step of displaying functions of at least one of the signal processing and the mixing processing in which the clip has occurred, on the block diagram.

According to the first aspect of the present invention, it is detected whether a clip occurs in any of signals of a plurality of input channels on which at least one of signal processing and mixing processing is performed, a block diagram showing functions of at least one of the signal processing and the mixing processing is displayed, and functions of at least one of the signal processing and the mixing processing in which the clip has occurred are displayed on the block diagram. Therefore, it is possible to quickly identify a clipping point and change the settings of signal processing.

Preferably, the block diagram display step comprises displaying at least one block diagram showing functions of at least one of the signal processing and the mixing processing performed on at least one signal of part of the plurality of input channels in which the clip is detected when the clip is detected in the clip detecting step.

To attain the above object, in a second aspect of the present invention, there is provided a clip state display apparatus comprising a clip detecting device that detects whether a clip occurs in any of signals of a plurality of input channels on which at least one of signal processing and mixing processing is performed, a display that displays a block diagram showing functions of at least one of the signal processing and the mixing processing, and displays functions of at least one of the signal processing and the mixing processing in which the clip has occurred, on the block diagram.

Preferably, the display displays at least one block diagram showing functions of at least one of the signal processing and the mixing processing performed on at least one signal of part of the plurality of input channels in which the clip is detected when the clip is detected by the clip detecting section.

To attain the above object, in a third aspect of the present invention, there is provided a clip state display program executed by a computer comprising a clip detecting module for detecting whether a clip occurs in any of signals of a plurality of input channels on which at least one of signal processing and mixing processing is performed, a block diagram display module for displaying a block diagram showing functions of at least one of the signal processing and the mixing processing, and a clip display module for displaying functions of at least one of the signal processing and the mixing processing in which the clip has occurred, on the block diagram.

Preferably, the block diagram display module comprises displaying at least one block diagram showing functions of at least one of the signal processing and the mixing processing performed on at least one signal of part of the plurality of input channels in which the clip is detected when the clip is detected by the clip detecting module.

The above and other objects, features, and advantages of the invention will become more apparent from the following detailed description taken in conjunction with the accompanying drawings.

BRIEF DESCRIPTION OF THE DRAWINGS

FIGS. 2A to 2D are flow charts showing processes carried out by the clip state display apparatus within the mixing apparatus (clip state display apparatus) in FIG. 1, in which FIG. 2A shows a routine for carrying out a normal process, FIG. 2B shows a subroutine for carrying out a process on a clip occurrence event, FIG. 2C shows a subroutine for carrying out a process on an encoder operation event, and FIG. 2D shows a subroutine for carrying out a process on a graph designation event.

DETAILED DESCRIPTION OF THE PREFERRED EMBODIMENTS

Figure 1:
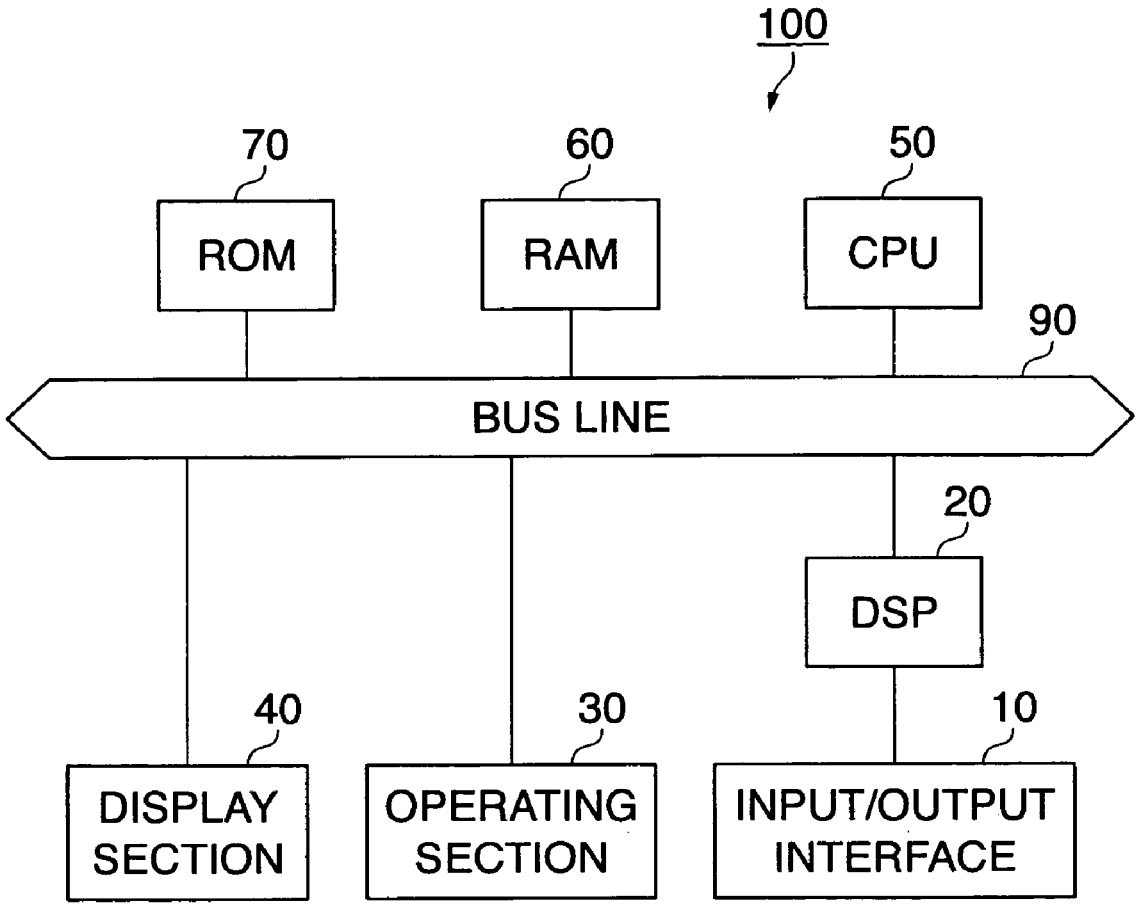
FIG. 1 is a block diagram showing the construction of a mixing apparatus incorporating a clip state display apparatus according to an embodiment of the present invention.

The present invention will now be described in detail with reference to the drawings showing a preferred embodiment thereof. In the drawings, elements and parts which are identical throughout the views are designated by identical reference numerals, and duplicate description thereof is omitted.

A description will now be given of a mixing apparatus in which a clip state display apparatus according to an embodiment of the present invention is incorporated, with reference to FIGS. 1 to 3.

FIG. 1 is a block diagram showing the construction of the mixing apparatus incorporating the clip state display apparatus according to the present embodiment.

In FIG. 1, reference numeral 10 denotes an input/output interface which is comprised of an analog input/output interface and a digital input/output interface, and provides interface for input and output of audio signals (including a musical tone signal). The input/output interface 10 is provided with a plurality of input terminals and output terminals, and musical tone equipment such as a microphone and an electronic musical instrument are connected to the input/output interface 10. It should be noted that the analog input/output interface employs an A/D converter and a D/A converter for conversion of analog audio signals and digital audio signals Reference numeral 20 denotes a DSP (Digital Signal Processor) which performs digital signal processing on audio signals corresponding to a plurality of channels input via the input/output interface 10. Reference numeral 30 denotes an operating section which is provided with various switches, a keyboard, and a mouse. Reference numeral 40 denotes a display section which is comprised of a liquid crystal display panel. Also, the display section 40 has a touch panel function; when the liquid crystal display panel is touched by hand, information indicative of the touched position is detected. Reference numeral 50 denotes a CPU which controls the overall operation of the mixing apparatus. Reference numeral 60 denotes a RAM which serves as a working memory. Reference numeral 70 denotes a flash ROM which stores control programs and various parameters as well as various settings of signal processing to be performed in the DSP 20. The DSP 20 is comprised of an attenuator (ATT) input section, equalizer (EQ) input section and output section, an insertion effect output section, noise gate (GATE) input section and output section, compressor (COMP) input section and output section, a level (LEVEL) output section, and a PAN input section.

Reference numeral 90 denotes a bus line which connects the component parts to each other. The above component parts constitute the mixing apparatus (clip state display apparatus) 100 according to the present embodiment.

A description will now be given of processes carried out by the mixing apparatus in FIG. 2 with reference to flow charts of FIGS. 2A to 2D.

Figure 2A:
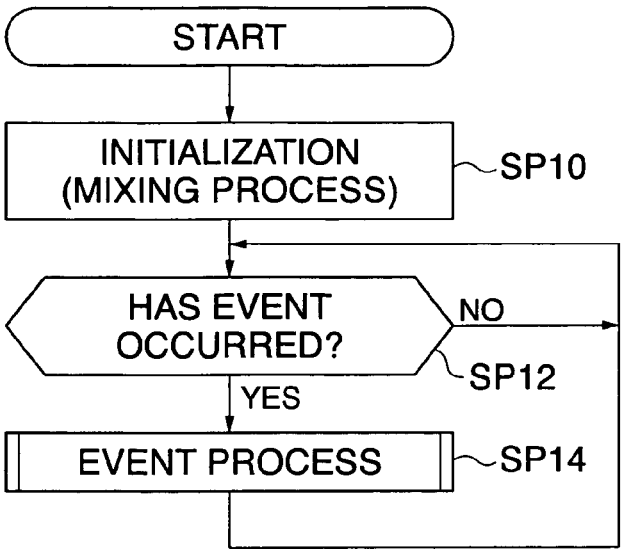
Figure 2C:
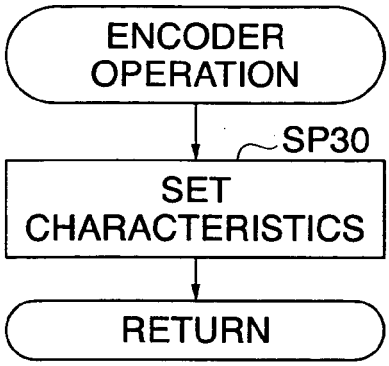

Simultaneously with turning-on of power supply, a routine for carrying out a normal process shown in FIG. 2A is started.

As shown in FIG. 2A, first, in a step SP10, the functions of the input/output interface 10 and the processing functions of the DSP 20 are initialized according to the contents stored in the flash ROM 70. As a result, the DSP 20 performs signal processing such as level adjustment and equalizer adjustment on audio signals input through a plurality of channels via the input/output interface 10, and mixing processing on the audio signals on which the signal processing has been performed. Then, an audio signal obtained by the mixing processing is output as a monaural signal or a stereo signal. Further, operating elements such as level encoders, level meters, and so forth are displayed according to the contents stored in the flash ROM 70. Then, the process proceeds to a step SP12.

In the step SP12, the CPU 50 determines whether any event has occurred or not. Examples of the event include a clip occurrence event, a graph designation event, and an encoder operation event, which will be described later. If no event has occurred, the determination result is negative (NO), and the process returns to the step SP12 wherein the determination is carried out again. On the other hand, if any event has occurred, the process proceeds to a step SP14 wherein an event process is carried out. For example, if a predetermined operating button is clicked, a characteristic setting screen for setting detailed characteristics of each function is displayed in the display section 40.

A description will now be given of a block diagram display process carried out by the mixing apparatus in FIG. 1.

A clip occurs when the level of an input signal becomes excessively high during mixing of audio signals input through a plurality of input channels. Here, the clip means a state where the signal level is excessively high and an instantaneous value thereof is limited to the maximum limit value of a digitalized signal thereof. Although described later in detail, when the clip occurs, a block diagram showing the functions of signal processing or mixing processing is displayed in the display section 40 for an input channel in which the clip has occurred. This block diagram may be displayed for an arbitrary channel according to an operation by a user irrespective of whether the clip has occurred or not. Further, a plurality of level meters are displayed above the block diagram, and a clip display section lights up so as to notify that the clip has occurred.

Figure 3:
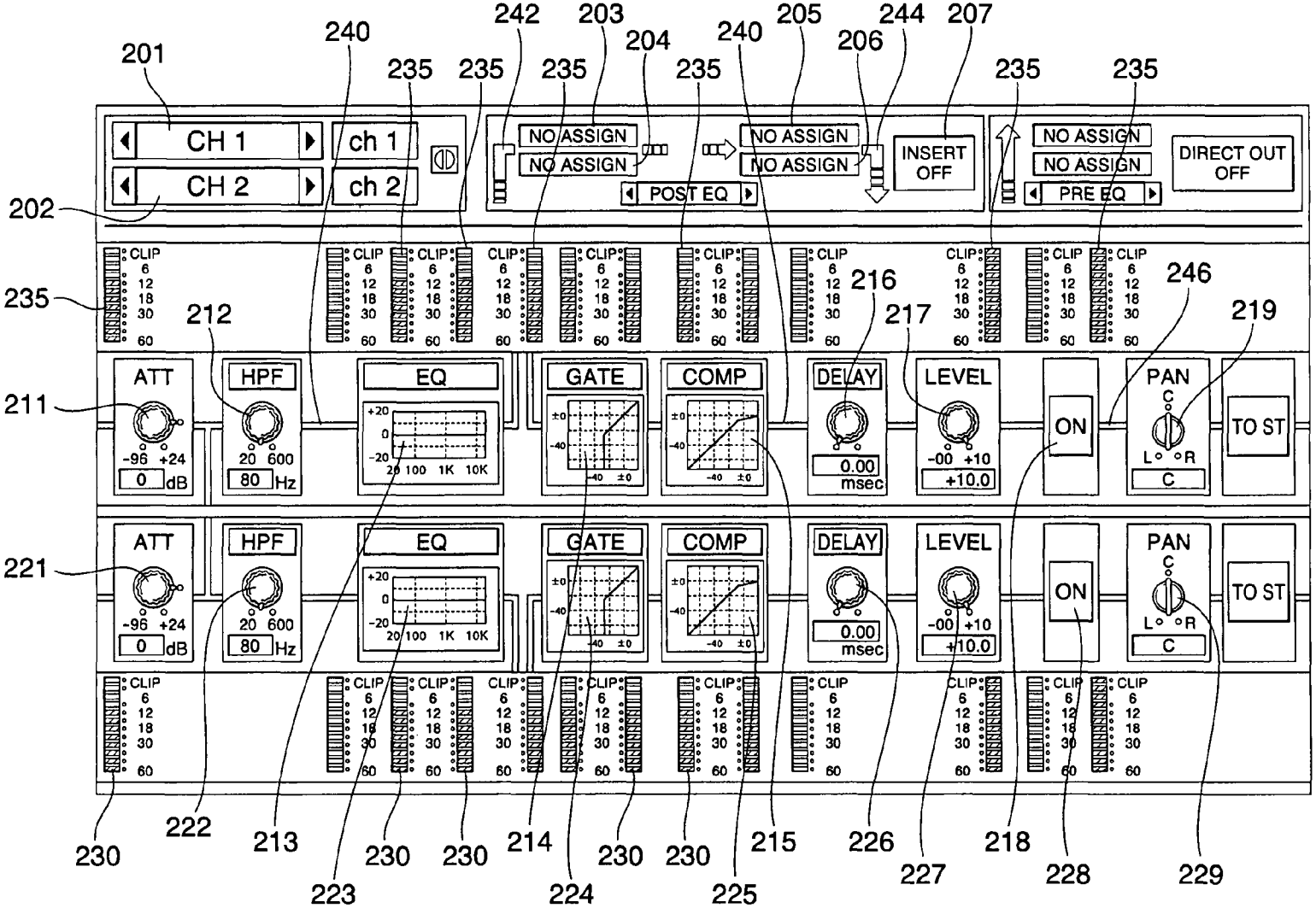
FIG. 3 is a view showing an example of block diagrams which are displayed in a display section appearing in FIG. 1.

Specifically, FIG. 3 shows an example of block diagrams and others displayed when the clip occurs in the first channel and the second channel. In the second row from the top in FIG. 3, level meters for the first channel are displayed, a block diagram for the first channel is displayed in the third row, a block diagram for the second channel is displayed in the fourth row, and level meters for the second channel are displayed in the fifth row. A description will now be given of the contents of the block diagrams and others, including the first row.

In FIG. 3, reference numerals 201 and 202 denote input channel switching menus; channels assigned to respective input terminals are switched by operating moving buttons arranged on the right and left of the input channel switching menus 201 and 202. In FIG. 3, the first channel is assigned to an input terminal "ch_1", and the second channel is input to an input terminal "ch_2". Reference numerals 211 and 221 denote attenuator (ATT) encoders; rotating each of the encoders 211 and 221 sets the rate of decrease of the input signal within a range between −96 dB and +24 dB. The rate of decrease of the input signal may also be set by directly inputting a numerical value in a "set value" input box, which is displayed in the vicinity of each of the encoders 211 and 221, using the keyboard.

Reference numerals 212 and 212 denote high-pass filter (HPF) encoders for setting the cut-off frequency of a high-pass filter within a range between 20 Hz and 600 Hz. Reference numerals 213 and 223 denote equalizer (EQ) graphs which show the set equalizer characteristics as frequency functions in the form of a graph. In FIG. 3, the gain is set to "0" dB within the entire frequency range between 20 Hz and 10 kHz, and thus flat frequency characteristics are displayed.

Reference numerals 214 and 224 denote noise gate (GATE) graphs which show the characteristics of a gate function for shutting off signal components (noises) not greater than a set level and allowing signal components not less than the set level to pass, in the form of a graph. Reference numerals 215 and 225 denote compressor (COMP) graphs which show the characteristics of a compressor function for reducing the amplification factor and allowing signals not greater than a set value to pass when the input level is not less than the set value, thereby compressing the output level. Reference numerals 216 and 226 denote DELAY encoders which set the delay time by which the input signal is delayed. For example, a DELAY function is used in correcting for a difference in time between two microphones which are arranged at a distance from each other.

Reference numerals 217 and 227 denote level (LEVEL) encoders which set the output level within a range between ∞ and +10 dB. Reference numerals 218 and 228 denote ON/OFF display devices which display whether the input signal is to be output or not. In FIG. 3, a switch, not shown, is set to an "ON" state, which means an audio signal is to be output. Reference numerals 219 and 229 denote PAN encoders which distribute audio signals to right and left output channels. In FIG. 3, the PAN encoders 219 and 229 are set to a center (C), which means the same amount of audio signals are distributed to the right and left output channels.

It should be noted that the distribution ratios of the high-pass filter (HPF) encoders 212 and 222, the DELAY encoders 216 and 226, the level (LEVEL) encoders 217 and 227, and the PAN encoders 219 and 229 are set by rotating as is the case with the attenuator (ATT) encoders 211 and 221. Further, if a "character button" of any of the high-pass filter (HPF) encoders 212 and 222, the equalizer (EQ) graphs 213 and 223, the noise gate (GATE) graphs 214 and 224, the compressor (COMP) graphs 215 and 225, and the DELAY encoders 216 and 226 is clicked, a "characteristic setting screen" for setting in detail the characteristics of the corresponding function is displayed although not illustrated in the drawings.

Reference numerals 203, 204, 205, and 206 denote insertion effect setting areas where an insertion effect such as echo is set. If an insertion effect is set, an "effect name" is displayed in the insertion effect setting areas 203, 204, 205, and 206. In FIG. 3, no insertion effect is set, and a character string "NO ASSIGN" is displayed.

Further, signals lines 240, 242, 244, and 246 are displayed which connect the above-mentioned encoders and graphs between the attenuator (ATT) encoder 221 and the PAN encoder 229 to each other. These component parts constitute the block diagrams showing flows of processing functions set in the respective input channels. The signal line 242 connects the equalizer (EQ) graphs 213 and 223 to the insertion effect setting ranges 203 to 206, and the signal line 244 connects the insertion effect setting areas 203 to 206 to the noise gate (GATE) graphs 214 and 224. Namely, an insertion effect function is inserted between the equalizer (EQ) function and the noise gate (GATE) function. The above components constitute the block diagrams of the respective channels. A description will now be given of the level meters which are displayed together with the block diagrams of the respective channels.

A plurality of level meters 230 and a plurality of level meters 235 appearing in FIG. 3 sequentially indicate the signal levels at respective metering points: the attenuator (ATT) input section, the equalizer (EQ) input and output sections, the noise gate (GATE) input and output sections, the compressor (COMP) input and output sections, the level (LEVEL) output section, and the PAN input section. At these metering points, the signal level of an audio signal is likely to increase due to processing. The top of each level meter is referred to as a clip display section which holds the occurrence of a clip (CLIP), and continues to light up until a predetermined resetting process (e.g. when a "clip reset" button, not shown, is clicked).

A description will now be given of a process which is carried out on a clip occurrence event by the mixing apparatus in FIG. 1.

In the case where the DSP 20 performs normal signal processing and mixing processing, when the input signal level becomes excessively high, and the clip occurs at one or a plurality of metering points, the DSP 20 generates a clip occurrence event.

Figure 2B:
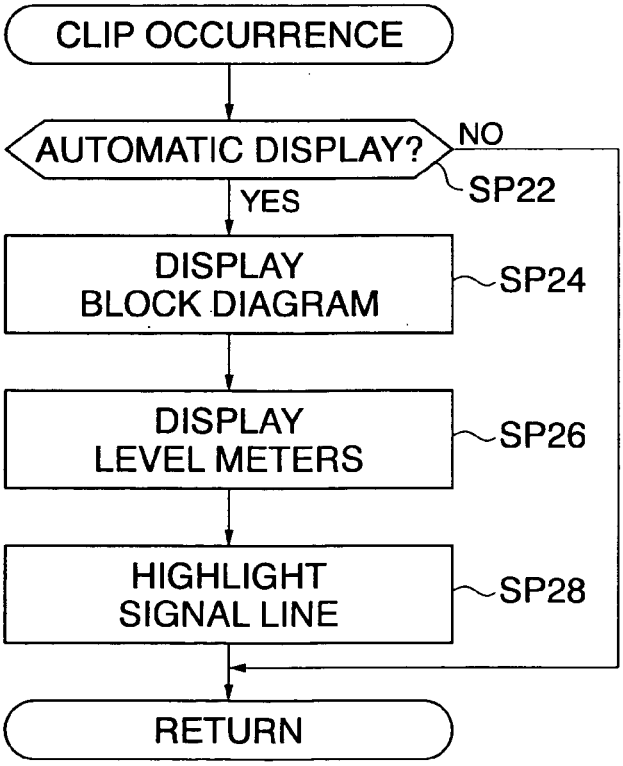
Figure 2D:
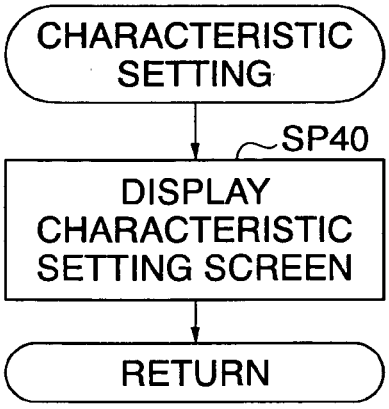

In the step SP12 in FIG. 2A, when the clip occurrence event is generated, the determination result is positive (YES), and the process proceeds to the event process in the step SP14 wherein the CPU 50 starts a subroutine for carrying out the process on the clip occurrence event (FIG. 2B).

In a step SP22, it is determined whether an "automatic display mode" is set or not. The "automatic display mode" is a mode in which one or more block diagrams as shown in FIG. 3 are automatically displayed when the clip occurs. If the "automatic display mode" is not set, the determination result is negative (NO), and the process returns to the routine for carrying out the original normal process. As a result, even though the clip has occurred, the same screen as before the occurrence of the clip is continuously displayed.

On the other hand, if the "automatic display mode" is set, the determination result is positive (YES), and the process proceeds to a step SP24. In the step SP24, one or more block diagrams (except level meters) for one or more input channels in which the clip has occurred are displayed. Then, the level meters 230 or 235 are displayed in a step SP26. Also, the clip display sections relating to the functions for which the clip has occurred light up. Specifically, the clip display sections relating to the level (LEVEL) output section and the PAN input section light up. This completes the display in the step SP26.

Then, the process proceeds to a step SP28 wherein the signal line relating to the functions for which the clip has occurred is highlighted. Specifically, in FIG. 3, the signal line 246 relating to the level (LEVEL) output section and the PAN input section is highlighted. Then, the process returns to the original normal process. As a result, in the step SP12, the determination as to whether or not there has been a clip occurrence event is carried out again (refer to FIG. 2A).

A description will now be given of a process which is carried out on a graph designation event by the mixing apparatus in FIG. 1.

When a subroutine in FIG. 2B is started to display the block diagram and functions on the block diagram are designated so as to change the characteristics thereof, a graph designation event occurs. Specifically, when any of the equalizer (EQ) graph 213 (223), the noise gate (GATE) graph 214 (224), and the compressor (COMP) graph 215 (225) is touched by hand, the display section 40 generates a graph designation event. Also when the touched graph is designated and clicked using the mouse, the operating section 30 generates a graph designation event.

Referring again to FIG. 2A, the determination result is positive (YES) in the step SP12 due to the occurrence of the graph designation event, and the process proceeds to the step SP14. Then, a subroutine in FIG. 2D for carrying out the process on the graph designation event is started. In a step SP40, a "characteristic setting screen" showing encoders for setting characteristics is displayed in the display section 40, and the process returns to the routine of the original normal process.

A description will now be given of a process which is carried out on an encoder operation event by the mixing apparatus in FIG. 1.

An encoder operation event occurs when any of the encoders displayed on the above-mentioned characteristic setting screen. Also, an encoder operation event occurs when any of the attenuator (ATT) encoders, high-pass filter (HPF) encoders, the DELAY encoders, and the level (LEVEL) encoder on the block diagrams in FIG. 3 is operated.

Referring again to FIG. 2A, the determination result is positive (YES) in the step SP12 due to the occurrence of the encoder operation event. Then, the process proceeds to the step SP14 wherein a subroutine in FIG. 2C for carrying out the process on the encoder operation event is started. In a step SP30, characteristics of each function are set again. In the example shown in FIG. 3, the clip state is avoided by adjusting the level (LEVEL) encoder 217 (227). The clip state can also be avoided by adjusting the attenuator (ATT) encoder 211 (221) or by readjusting the compressor. Then, the process returns to the original normal process. It should be noted that the clip display sections are turned off by carrying out a predetermined resetting process (e.g. clicking of a "clip reset" button, not shown).

As described above in detail, according to the present embodiment, when the clip is detected (step SP12), the functions of the signal processing or the mixing processing which is performed on the signal that has clipped is displayed on the block diagram (step SP24). As a result, clipping points can be immediately identified and the settings of signal processing can be quickly changed. Also, since a characteristic setting page is displayed by designating/selecting graphs displayed on the block diagram, it is possible to immediately reset the characteristics of each function.

It should be understood that the present invention is not limited to the embodiment described above, but various changes in or to the above described embodiment may be possible without departing from the spirits of the present invention, including changes as described below.

Although in the above described embodiment, when an audio signal corresponding to any of the input channels is clipped while level meters and level encoders of all the input channels are displayed as usual, the block diagram of the input channel in which the signal has clipped is automatically displayed (step SP24 in FIG. 2B), an operation mode may be provided in which the block diagrams of all the input channels are normally displayed, and when a clip occurs, graphs for the channel of a signal that has clipped are designated to display a function setting screen. Further, when a signal is clipped, a characteristic setting screen of a block which causes the clip is directly displayed to prompt setting change. For example, when a clip occurs in an EQ (equalizer) of a certain channel, an alarm is given to notify the occurrence of the clip, and a characteristic setting screen for the EQ is displayed to wait for correction.

It goes without saying that the object of the present invention may also be accomplished by supplying a system or an apparatus with a storage medium (or a recording medium) in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and a storage medium on which the program code is stored constitute the present invention.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing the program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

Further, the above program has only to realize the functions of the above-mentioned embodiment on a computer, and the form of the program may be an object code, a program executed by an interpreter, or script data supplied to an OS.

Examples of the storage medium for supplying the program code include a floppy (registered trademark) disk, a hard disk, an optical disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program is supplied by downloading from another computer, a database, or the like, not shown, connected to the Internet, a commercial network, a local area network, or the like.

What is claimed is:

1. A clip state display method for a clip state display apparatus having a plurality of input channels on which at least one of signal processing and mixing processing is performed, each of the input channels including two or more function sections of at least one of signal processing and mixing processing, at least two function sections having two corresponding level meters, said clip state display method comprising:

a clip detecting step of detecting, by the level meters at clip metering points for an input section and an output section of each of the at least two function sections, whether a clip occurs in any of signals of a plurality of input channels on which at least one of signal processing and mixing processing is performed;

a block diagram display step of displaying a block diagram showing function sections of at least one of the signal processing and the mixing processing;

a clip display step of displaying function sections of at least one of the signal processing and the mixing processing in which the clip has occurred, on the block diagram; and a highlighting step of highlighting, on the block diagram, a signal line relating to the function sections for which the clip has occurred, wherein said block diagram display step comprises displaying at least one block diagram showing function sections of at least one of the signal processing and the mixing processing performed on at least one signal of part of the plurality of input channels in which the clip is detected when the clip is detected in said clip detecting step.

2. A clip state display apparatus comprising:

a plurality of input channels on which at least one of signal processing and mixing processing is performed, each of the input channels including two or more function sections of at least one of signal processing and mixing processing, at least two function sections having two corresponding level meters;

a clip detecting device that detects, by the level meters at clip metering points for an input section and an output section of each of the at least two function sections, whether a clip occurs in any of signals of a plurality of input channels on which at least one of signal processing and mixing processing is performed;

a display that displays a block diagram showing function sections of at least one of the signal processing and the mixing processing, and displays function sections of at least one of the signal processing and the mixing processing in which the clip has occurred, on the block diagram; and a processor that highlights, on the block diagram, a signal line relating to the function sections for which the clip has occurred, wherein said display displays at least one block diagram showing function sections of at least one of the signal processing and the mixing processing performed on at least one signal of part of the plurality of input channels in which the clip is detected when the clip is detected by said clip detecting section.

3. A computer-readable storage medium storing a clip state display program causing a computer to execute a clip state display method for a clip state display apparatus having a plurality of input channels on which at least one of signal processing and mixing processing is performed, each of the input channels including two or more function sections of at least one of signal processing and mixing processing, at least two function sections having two corresponding level meters, said clip state display method comprising:

a clip detecting step of detecting, by the level meters at clip metering points for an input section and an output section of each of the at least two function sections, whether a clip occurs in any of signals of a plurality of input channels on which at least one of signal processing and mixing processing is performed;

a block diagram display step of displaying a block diagram showing function sections of at least one of the signal processing and the mixing processing;

a clip display step of displaying function sections of at least one of the signal processing and the mixing processing in which the clip has occurred, on the block diagram; and a highlighting step of highlighting, on the block diagram, a signal line relating to the function sections for which the clip has occurred, wherein said block diagram display module comprises displaying at least one block diagram showing function sections of at least one of the signal processing and the mixing processing performed on at least one signal of part of the plurality of input channels in which the clip is detected when the clip is detected by said clip detecting module.

* * * * *